United States Patent [19]

Ullmann

[11] 4,251,915

[45] Feb. 24, 1981

[54] DRY SHAVER

[75] Inventor: Roland Ullmann, Hausen, Fed. Rep. of Germany

[73] Assignee: Braun AG, Frankfurt am Main, Fed. Rep. of Germany

[21] Appl. No.: 34,440

[22] Filed: Apr. 30, 1979

[30] Foreign Application Priority Data

May 5, 1978 [DE] Fed. Rep. of Germany ..... 2819715

[51] Int. Cl.[3] ..... B26B 19/04; B26B 21/40

[52] U.S. Cl. ..... 30/43.92; 30/90

[58] Field of Search ..... 16/86 R; 30/34 R, 43, 30/43.92, 90; 248/345.1

[56] References Cited

U.S. PATENT DOCUMENTS

| | | | |
|---|---|---|---|
| 2,597,552 | 5/1952 | Wagner | 30/90 |
| 3,171,567 | 3/1965 | Somers | 30/90 X |
| 3,388,468 | 6/1968 | Hamill | 30/90 |
| 3,991,537 | 11/1976 | Brown | 248/345.1 X |

*Primary Examiner*—Gary L. Smith

*Attorney, Agent, or Firm*—Michael J. Striker

[57] ABSTRACT

A dry shaver includes a housing which has an inner surface which bounds an interior of the housing, receiving an installation of the dry shaver, and an outer exposed surface. A plurality of elastic portions extend outwardly beyond the outer surface at a plurality of locations so as to protect the housing against damage due to scratching and impacts.

14 Claims, 4 Drawing Figures

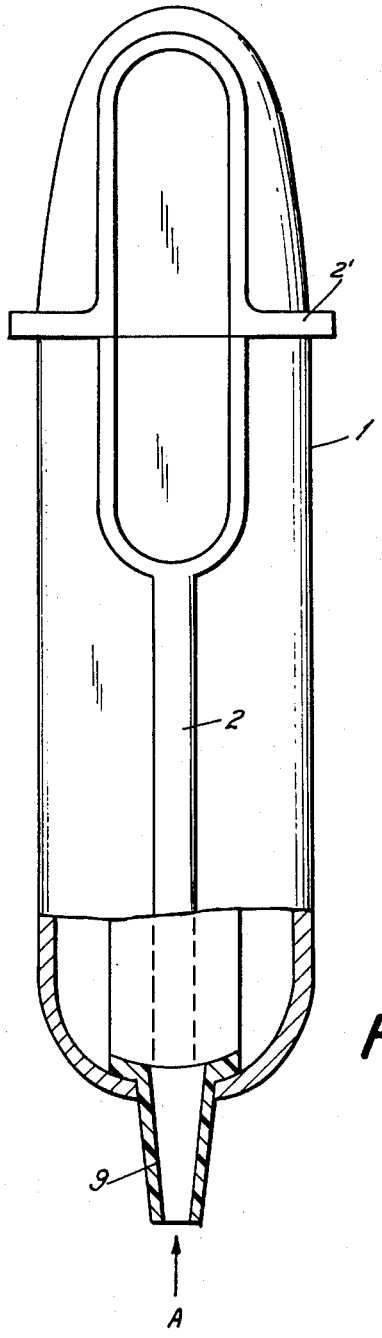
FIG. 3
FIG. 4
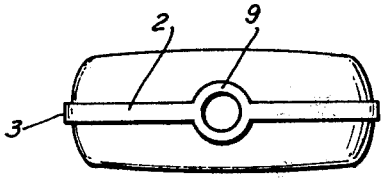

DRY SHAVER

BACKGROUND OF THE INVENTION

The present invention relates to dry shavers. A dry shaver has a hollow housing having an inner surface bounding an interior of the housing and receiving the dry shaver mechanism, and an outer exposed surface.

The housing is usually made of a hard material, so that the mechanism can be precisely and reliably fixed inside the housing. At the same time such a housing protects the parts of the mechanism against any damage from outside of the housing. The housing may be manufactured, for example, from thermosetting plastics. Because of some other considerations, e.g. visual and technical, at least some parts of the housing are made of metal. A shearing head (i.e. insert) which is manufactured as a part of the housing, is, as a rule, of steel.

When such a dry shaver is put on a supporting surface, for example, of a table or the like, the outer surface of the housing may become damaged due to scratching and impacts. Moreover, the supporting surface may also become damaged. On the other hand, the impacts on the outer surface of the housing may negatively affect different parts of the installation inside the housing.

SUMMARY OF THE INVENTION

It is a general object of the present invention to avoid the disadvantages of the prior art dry shavers.

More particularly, it is an object of the present invention, to provide a dry shaver having a housing which is substantially protected against damage due to scratching and impacts.

In pursuance of these objects and others which will become apparent hereafter, one feature of the present invention resides in a dry shaver which includes a hollow housing having an outer exposed surface and bumper means projecting outwardly beyond said outer surface at a plurality of locations, so as to protect said housing against damage due to scratching and impacts.

Such an arrangement renders it possible to protect a supporting surface, for example, of a table, from becoming damaged when the dry shaver is put on such a supporting surface and, conversely, also to protect the surface of the dryshaver housing. This is especially true in the event when, for example, the dry shaver inadvertently slips out of the hands of a user and falls on the supporting table.

The bumper means include a resilient edge projection extending outwardly beyond the outer surface of the dryshaver. Obviously, such a projection (or projections) substantially reduces the chances that the dry shaver will slip out of the hands of the user.

The projection extends beyond the outer surface of the housing by such a distance that any damage of the housing is entirely excluded.

On the other hand any impacts on the resilient projection (i.e. bumper means) are not transmitted on the installation inside the housing.

According to another feature of the invention, the resilient projection constitutes an elastic insert which is located between respective engaging surfaces of separate parts of the housing. Such an arrangement is especially advantageous, since the housing does not have to be provided with any additional elements for receiving the elastic insert which (when the separate parts are assembled with one another so as to constitute together the housing) projects outwardly beyond the outer surface of the housing. In this context, it is to be said that the elastic insert ensures an adequately reliable sealing of the housing especially in the areas where the separate parts of the housing are connected to one another. Thus, penetration of moisture or dirt into the housing is prevented by this elastic insert.

According to still another feature of the invention, the elastic insert not only projects beyond the outer surface of the housing but covers an inner surface of the same. Such an arrangement makes it possible to hermetically insulate the installation inside the housing from the exterior thereof, so that the installation is entirely protected against penetration of moisture. Besides, the elastic cover of the inner surface of the housing additionally increases the bumper effectiveness, since the mechanism of the dry shaver is surrounded inside the rigid housing by the elastic material in a manner similar to that of a shock-resistant watch. It is to be mentioned that the extension of the elastic insert over the entire inner surface of the housing (or only a portion thereof) does not cause any significant additional expenses. On the other hand, the elastic cover of the inner surface of the housing substantially absorbs noise caused by the mechanism (when the latter is in operation).

In the case of an electric dry shaver which is operated from an external power supply, the resilient projection may be provided with a cable sleeve (i.e. bushing) extending outwardly beyond the outer surface of the housing.

It is very convenient that the elastic bumper projection performs the sealing of the engageable parts of the housing. Obviously, any additional expenses for the sealing are excluded.

In a further feature of the present invention, a shear head (i.e. insert), when the latter is in assembly with the housing, is surrounded by a portion of the above mentioned elastic projection. Such an arrangement guarantees that the noise in the shear head (during the operation of the dry shaver) is substantially absorbed. On the other hand, when the user shaves relatively remote and inconveniently accessible parts of the face, the face contacts substantially not with the outer surface of the shear head, but with the elastic projection which surrounds the shear head. Thus, any scratching of or impacts on the face of the user are excluded.

Unintended switching-on of the dry shaver, when the latter is put on a supporting surface, (i.e. with the switching surface of the dry shaver against the supporting surface), is prevented since the switch (e.g. a pushbutton) may be recessed inwardly of the elastic projection.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 3 is a side view of a still another embodiment of the dry shaver; and

FIG. 4 is a view of the dry shaver as seen in the direction of the arrow A shown in FIG. 3.

DESCRIPTION OF PREFERRED EMBODIMENTS

Figure 1:
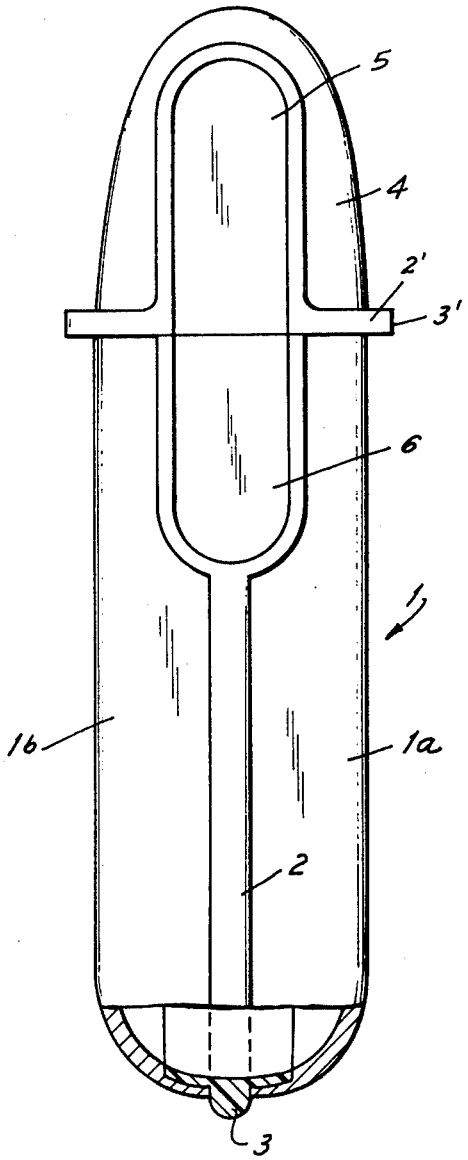
FIG. 1 is a side view of a dry shaver according to the present invention.

Referring now to the drawings and first to the FIG. 1 thereof, it may be seen that the reference numeral 1 designates in toto a housing made of a relatively hard material. The housing 1 includes a part 1*a* and a part 1*b*. Between the parts 1*a* and 1*b* there is provided an insert 2 made of elastic material, for example synthetic plastic material such as rubber or any other soft material. The insert 2 projects with its portion 3 outwardly beyond the outer surface of the housing 1.

A similar insert 2′ is provided in a shear head 4 of the dry shaver. In other words, when the shear head 4 is installed on the housing 1, the insert 2′ is located between the head 4 and the housing 1 and projects outwardly beyond the outer surface of both by a portion 3′.

The shear head 4 is provided with a gripping portion 5 for holding the head 4 when the latter is installed on or removed from the housing 1. The gripping portion 5 is also surrounded by the elastic portion 3′. The gripping portion 5 is adjacent to a portion 6 for a switch button (not shown) for switching on and shutting off the dry shaver.

The portion 6 is also surrounded (i.e. enclosed) by the elastic portion 3.

Figure 2:
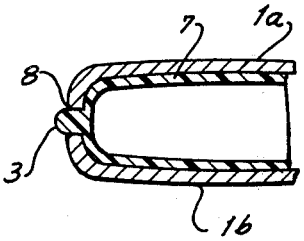
FIG. 2 is a sectional view of a portion of another embodiment of the dry shaver shown in FIG. 1.

FIG. 2 shows another embodiment of the dry shaver which has the housing including two parts 1*a* and 1*b*. The inner surface of the housing shown in FIG. 2 is covered with a layer 7 which constitutes a part of the elastic insert having a projection 8 which extends between the respective engaging surfaces of the parts 1*a* and 1*b* and outwardly beyond the outer surface of the housing. The elastic layer 7 ensures that the mechanism inside the housing is entirely sealed from outside of the housing. The mechanism itself is known per se and therefore does not require a detailed discussion or illustration.

FIGS. 3 and 4 show still another embodiment of the dry shaver, having a housing 1 similar to that shown in FIG. 1. The insert 2 is provided with an integral portion which constitutes a cable sleeve 9. The sleeve 9 projects outwardly beyond the outer surface of the housing 1. Such a construction renders it possible to reduce the manufacturing expenses of the insert 2 and the cable sleeve 9 in particular, and the dry shaver in general. On the other hand, the insert 2 and the cable sleeve 9 may be installed on the housing 1 in a simple and fast manner.

It will be understood that each of the elements described above, or two or more together, may also find a useful application in other types of dry shavers differing from the types described above.

While the invention has been illustrated and described as embodied in a dry shaver, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a dryshaver, a combination comprising a hollow housing having an outer exposed surface and including at least two separate parts each having engaging surfaces for connecting said parts to each other; and bumper means projecting outwardly beyond said outer surface at a plurality of locations, and including at least one flange on said housing projecting outwardly beyond said housing; and further including an insert portion located between said engaging surfaces of said parts when the latter are in assembly with each other, so as to protect said housing against damage due to scratching and impacts.

2. A combination as defined in claim 1, wherein said housing is of hard material.

3. A combination as defined in claim 1, wherein said bumper means include a plurality of flanges on said housing and projecting outwardly beyond the latter.

4. A combination as defined in claim 1, wherein said flange is of soft material.

5. A combination as defined in claim 1, wherein said flange is of synthetic plastic material.

6. A combination as defined in claim 1, wherein said flange is of rubber.

7. A combination as defined in claim 1, wherein said flange is integrally connected to said insert portion.

8. A combination as defined in claim 1, means for covering an inner surface of said housing, and including a cover portion.

9. A combination as defined in claim 8, wherein said cover portion is integrally connected with said insert portion.

10. A combination as defined in claim 1, wherein said flange is provided with a formation constituting a cable sleeve extending outwardly beyond the outer surface of said housing.

11. A combination as defined in claim 1, and further comprising means for sealing the housing when said separate parts are in assembly with each other.

12. A combination as defined in claim 11, wherein said sealing means comprise said insert portion.

13. A combination as defined in claim 1, wherein said housing is provided with a portion operative for receiving a switching button therein, said flange being adapted to surround said portion.

14. A combination as defined in claim 1, wherein said housing includes a detachable part constituting a shearing head of the dry shaver having engaging areas for connecting said detachably part and said housing to each other, said flange including a flange insert portion located between said engaging areas of said detachable part and said housing when the latter are in assembly with each other.

* * * * *